US008001956B1

(12) United States Patent
Bourgeois et al.

(10) Patent No.: US 8,001,956 B1
(45) Date of Patent: Aug. 23, 2011

(54) OUTDOOR COOKING APPARATUS WITH REMOVABLE HEAT SHIELD

(76) Inventors: Barbara Bourgeois, River Ridge, LA (US); Norman Bourgeois, River Ridge, LA (US); Michael Bourgeois, Kenner, LA (US)

( * ) Notice: Subject to any disclaimer, the term of this patent is extended or adjusted under 35 U.S.C. 154(b) by 1006 days.

(21) Appl. No.: 11/755,606

(22) Filed: May 30, 2007

Related U.S. Application Data

(60) Provisional application No. 60/803,669, filed on Jun. 1, 2006.

(51) Int. Cl.
*F24C 3/12* (2006.01)

(52) U.S. Cl. ..... 126/40; 126/30; 126/9 R; 126/50; 99/340; 99/413

(58) Field of Classification Search ..... 108/157.18, 108/158.12, 175; 99/415, 340, 413; 126/40, 126/30, 9 R, 50, 39 R, 38, 9 B, 214 D, 92 B
See application file for complete search history.

(56) References Cited

U.S. PATENT DOCUMENTS

| | | | | | |
|---|---|---|---|---|---|
| 943,569 | A | * | 12/1909 | Soamardi | 126/38 |
| 1,335,375 | A | | 3/1920 | Irion | |
| 1,662,587 | A | * | 3/1928 | Rodgers | 62/461 |
| 1,671,677 | A | | 5/1928 | Keeton | |
| 1,679,567 | A | | 8/1928 | Gardner | |
| 1,859,615 | A | | 5/1932 | Brierley et al. | |
| 2,355,948 | A | | 8/1944 | Bonstow et al. | |
| 2,414,679 | A | | 1/1947 | West | |
| 2,485,774 | A | | 10/1949 | Richmond | |
| 5,065,735 | A | | 11/1991 | Bourgeois et al. | |
| 5,682,872 | A | * | 11/1997 | Whitted | 126/29 |
| 5,758,569 | A | | 6/1998 | Barbour | |
| 5,813,321 | A | | 9/1998 | Bourgeois | |
| 5,970,852 | A | | 10/1999 | Bourgeois | |
| 6,058,830 | A | | 5/2000 | Bourgeois | |
| 6,182,650 | B1 | * | 2/2001 | Tuttle | 126/30 |
| 6,314,869 | B1 | | 11/2001 | Bourgeois, Jr. | |
| 6,439,107 | B1 | | 8/2002 | Bourgeois | |
| 6,776,084 | B2 | * | 8/2004 | Wild | 99/339 |
| 6,851,419 | B2 | * | 2/2005 | Reiner | 126/9 B |
| 6,957,649 | B1 | * | 10/2005 | Bourgeois | 126/40 |

* cited by examiner

*Primary Examiner* — Kenneth B Rinehart
*Assistant Examiner* — Daniel A Bernstein
(74) *Attorney, Agent, or Firm* — Garvey, Smith, Nehrbass & North, L.L.C.; Charles C. Garvey, Jr.

(57) ABSTRACT

A cooking apparatus includes a frame with an upper section for holding a pot and a lower section for resting upon an underlying support surface. The frame has a burner element that can be a nozzle tube having a commercially available burner nozzle for generating a cooking flame during use. The nozzle can be fueled with propane, butane or the like using a commercially available tank, regulator and supply hose. The frame can include an upper ring, lower rings, the upper ring providing legs, pot support bars or members for holding the bottom of a pot. A heat shield is comprised of multiple specially configured sections that overlap and connect to the frame. The shield is positioned below the flame during use to lessen heat transfer from the flame to the underlying support surface.

14 Claims, 5 Drawing Sheets

OUTDOOR COOKING APPARATUS WITH REMOVABLE HEAT SHIELD

CROSS-REFERENCE TO RELATED APPLICATIONS

Priority of U.S. Provisional Patent Application Ser. No. 60/803,669, filed Jun. 1, 2006, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to outdoor cooking devices and cooking accessories and more particularly to an outdoor cooker that is supplied with a source of gaseous fuel such as butane or propane from a canister and that can optionally include a pot and pot liner, the improvement including a special configuration of a multi-section heat shield that protects an underlying support (e.g. wood deck or table) when a user foolishly places the burner on a combustible or heat sensitive surface (for example, wood, paper, or plastic).

2. General Background of the Invention

A number of outdoor cookers have been sold commercially for a number of years and are admitted as "prior art" type burners. These "prior art" burners have traditionally included a metallic frame that supports a burner nozzle, such as a cast iron burner nozzle. Such burner nozzles are commercially available and are often a component part of natural gas fired hot water heaters.

Recently, U.S. Pat. No. 6,957,649 issued to Norman Bourgeois (applicant herein) that features a cooking apparatus having a burner with a heat shield that is designed to prevent heat damage to an underlying support surface that is selected by a user.

Recently, U.S. Pat. No. 6,957,649 issued to Norman Bourgeois entitled "Gas Fired Outdoor Cooking Apparatus", the burner in that patent having a shield that reflects burner heat away from an underlying support surface (e.g. floor or deck).

Patents have issued naming Norman Bourgeois (applicant herein) as inventor that relate to burners and related cooking apparatus. Examples include U.S. Pat. No. 5,065,735 for a "Convertible Burner Apparatus" that features different primary burner frames and legs that can elevate the burner frames. Other patents that relate to cooking devices include the aforementioned, and the following U.S. Pat. Nos. 1,335,375; 1,671,677; 1,679,567; 1,859,615; 2,355,948; 2,414,679; 2,485,774; 5,065,735; 5,758,569; 5,813,321; 5,970,852; 6,058,830; 6,314,869; 6,439,107, each of which is hereby incorporated herein by reference.

The burner nozzle can be a cast iron hot water heater type burner nozzle or a jet burner arrangement that uses a single orifice or outlet centered in a cylindrically-shaped, vertically oriented metallic tube. Probably the most common version of the prior art "jet burner" arrangement is seen in Metal Fusion's catalog as Model No. 90PK. Another version of this type of cooker includes two spaced apart circular rings connected with struts and having a cylindrically-shaped wind guard or shroud. This type of prior art burner can be seen for example as Metal Fusion Model Nos. 82PK, 83PK, 85PK, 86PK, and 86PKJ. A prior art portable propane outdoor cooker, various outdoor fryers, and other outdoor cookers and related accessories are shown on the Metal Fusion website (www.KingKooker.com). A common prior art outdoor cooker is shown on this website as the "Portable Propane Outdoor Jet Cooker".

One of the problems with outdoor cookers is the unfortunate and foolish user that places the burner on a combustible or heat sensitive surface such as a wooden deck, wooden table, plastic table, plastic deck or on newspaper that is spread on a table, floor, etc. If the burner is operated at a very high intensity for a period of time over a dry combustible such as a deck or table, damage or fire could result.

BRIEF SUMMARY OF THE INVENTION

The present invention includes a burner frame having a base for engaging an underlying support surface, the burner frame having a burner nozzle for generating a high intensity flame for use in cooking. A supply hose can be connected to the nozzle for supplying butane, propane or other gaseous fuel product to the burner nozzle. The burner frame has a support surface for cradling a pot.

The burner frame includes a base portion (e.g. legs and/or ring) and an upper portion having a pot supporting grate.

The upper portion has pot support bars forming the grate (e.g. multiple grate members) that can extend horizontally to cradle the bottom of a cooking pot.

A multi-section heat shield removably connects to the burner frame at a position below the flame that emits from the nozzle tube.

The burner element can be a vertically oriented tube with a hollow bore. A nozzle is typically placed inside the tube bore so that during cooking the nozzle discharges gaseous fuel upwardly to supply a flame for cooking. Such a vertical tube, bore and nozzle arrangement per se is well known in the art, having been widely sold for decades (e.g. see www.kingkooker.com and the "Portable Propane Outdoor Jet Cooker").

The shield is placed below the flame emitted by the nozzle. When a vertical tube and nozzle are used, the shield can be placed next to or below the vertical tube.

The shield can be of a transverse diameter that is much greater than the transverse diameter of the tube, and can be of a diameter approaching pot diameter or greater than pot diameter.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
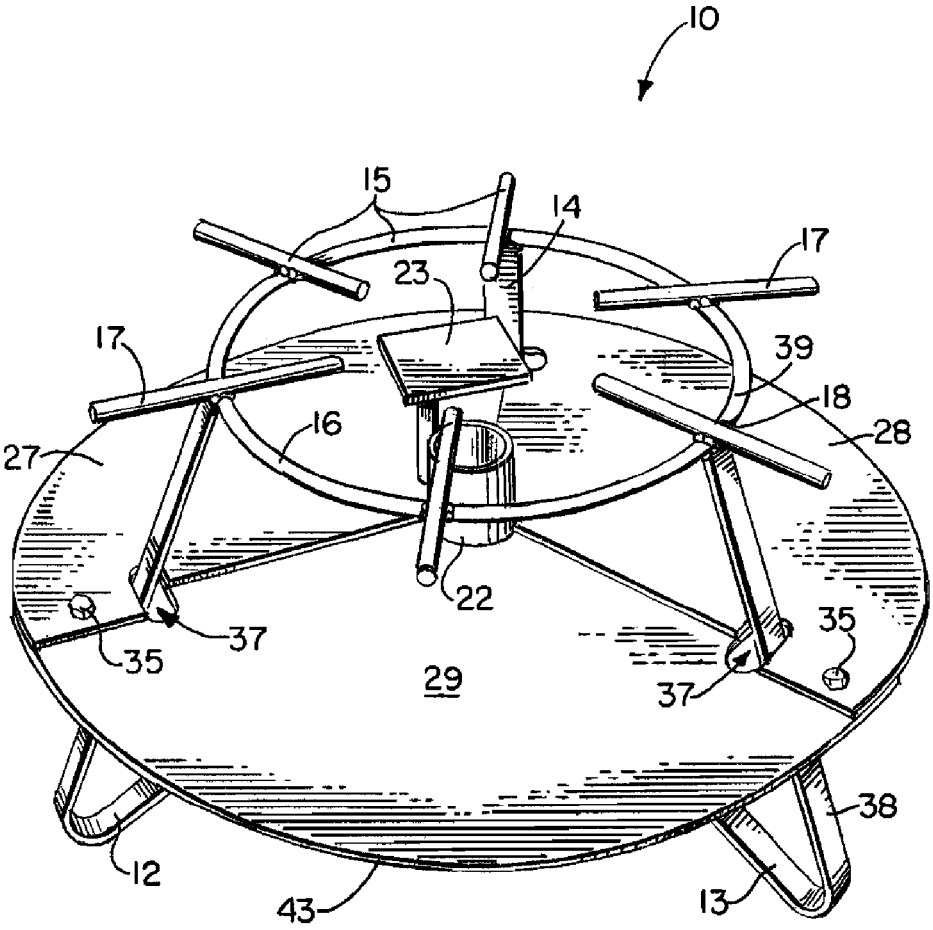
FIG. 1 is a perspective view of the preferred embodiment of the apparatus of the present invention.
Figure 2:
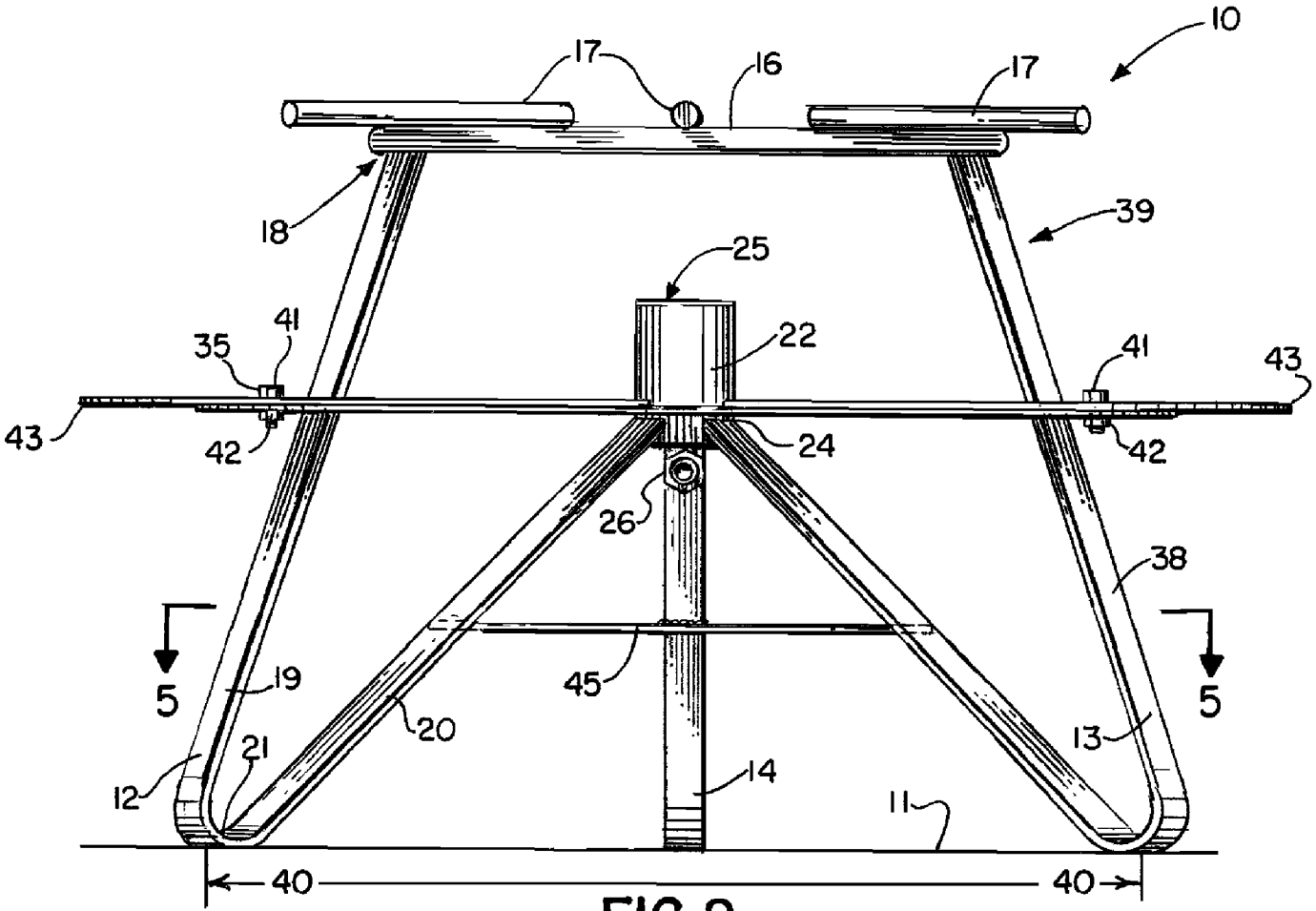
FIG. 2 is a side view of the preferred embodiment of the apparatus of the present invention.

FIGS. 1-5 show the preferred embodiment of the apparatus of the present invention designated generally by the numeral 10 in FIGS. 1-2. Outdoor cooking apparatus 10 is shown in FIGS. 1 and 2 resting upon an underlying support surface 11. Though the underlying support surface should be a flame proof material such as a concrete slab, foolish or unsafe users sometimes place outdoor cooking devices on combustible surfaces such as a wooden deck or plastic table.

A burner frame 38 includes a plurality of legs such as the three legs 12, 13, 14 shown in the drawings. The burner frame 38 has an upper end portion 39 that provides a grate 15 for supporting a pot. The grate 15 can be comprised of a ring 16 and a plurality of circumferentially spaced apart, radially extending pot support bars 17. The pot support bars 17 can be welded to ring 16. A leg 12, 13, 14 can be welded to ring 16 at a position that also carries a pot support bar 17 wherein a joint 18 such as a weld can be used to secure the three parts (a leg 12 or 13 or 14, ring 16 and a bar 17) together.

Each leg 12, 13, 14 can be comprised of an outer leg section 19, and inner leg section 20 and bend 21. The bend 21 can function as a foot, being that part of the frame 38 that engages the underlying support surface 11 (see FIG. 2).

A nozzle tube 22 carries a jet baffle 23. It should be understood that the nozzle tube 22 and jet baffle 23 are known components for generating a highly intense flame for cooking when using the outdoor apparatus 10 of the present invention. Such a nozzle tube 22 and jet baffle 23 can be seen for example in prior U.S. Pat. No. 6,957,649 which is incorporated herein by reference. As is known, the nozzle tube 22 carries a nozzle jet positioned just below or within tube bore 25 from which the flame is emitted. A weld 24 can be used to connect the leg 11, 12, 13 inner leg section 20 to the nozzle tube 22. Reference numeral 26 in FIG. 2 denotes a fuel line (e.g. pipe) that carries the burner element for generating a flame in and above tube 22.

A fuel line 26 can be used for supplying a gaseous fuel material to the nozzle jet within bore 25. Such fuel can be a canister of butane, propane, or the like.

Baffle or heat shield 43 is comprised of a plurality of baffle sections 27, 28, 29. Each baffle section 27, 28, 29 has an arcuate inner edge 30 and an arcuate outer edge 31. Each baffle section 27, 28, 29 provides radially extending edges 32, 32A and 33, 33A that form an angle of about 120 degrees. Each baffle section 27, 28, 29 provides an opening 44 next to each edge 32A, 33A.

A slot 34 is provided on each baffle section 27, 28, 29 at the joint of radial edges 32, 33 and 32A, 33A. The slots 34 are open ended. Upon assembly of the three baffle sections 27, 28, 29 using a bolted connection 35 (bolt 41, nut 42) for example, there is an area of overlap 36 between each baffle section 27 and the baffle section 28 or 29 that is next to it. One or more bolted connections can be used to join each baffle section 27, 28, 29 to another baffle section 27, 28, 29 at the area of overlap 36 by passing the bolt 41 through aligned openings 44 of two baffle sections 27, 28 or 28, 29 or 27, 29.

Figure 4:
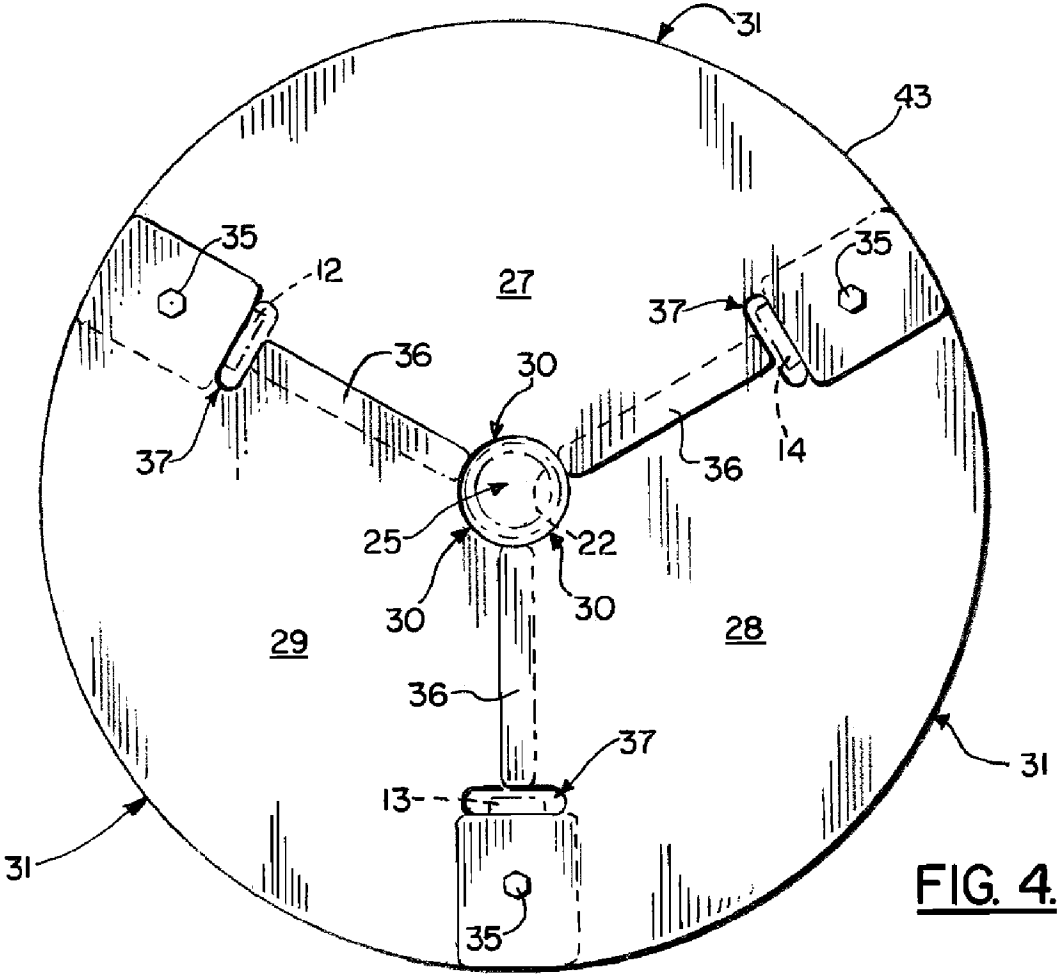
FIG. 4 is a partial plan view of the preferred embodiment of the apparatus of the present invention.

When the baffle sections 27, 28, 29 are assembled and bolted together as shown in FIGS. 1 and 4, the slots 34 of two adjacent baffle sections such as 27 and 28 in FIGS. 1 and 4 form a leg opening 37 that is receptive of one of the legs 12, 13, or 14.

Figure 3:
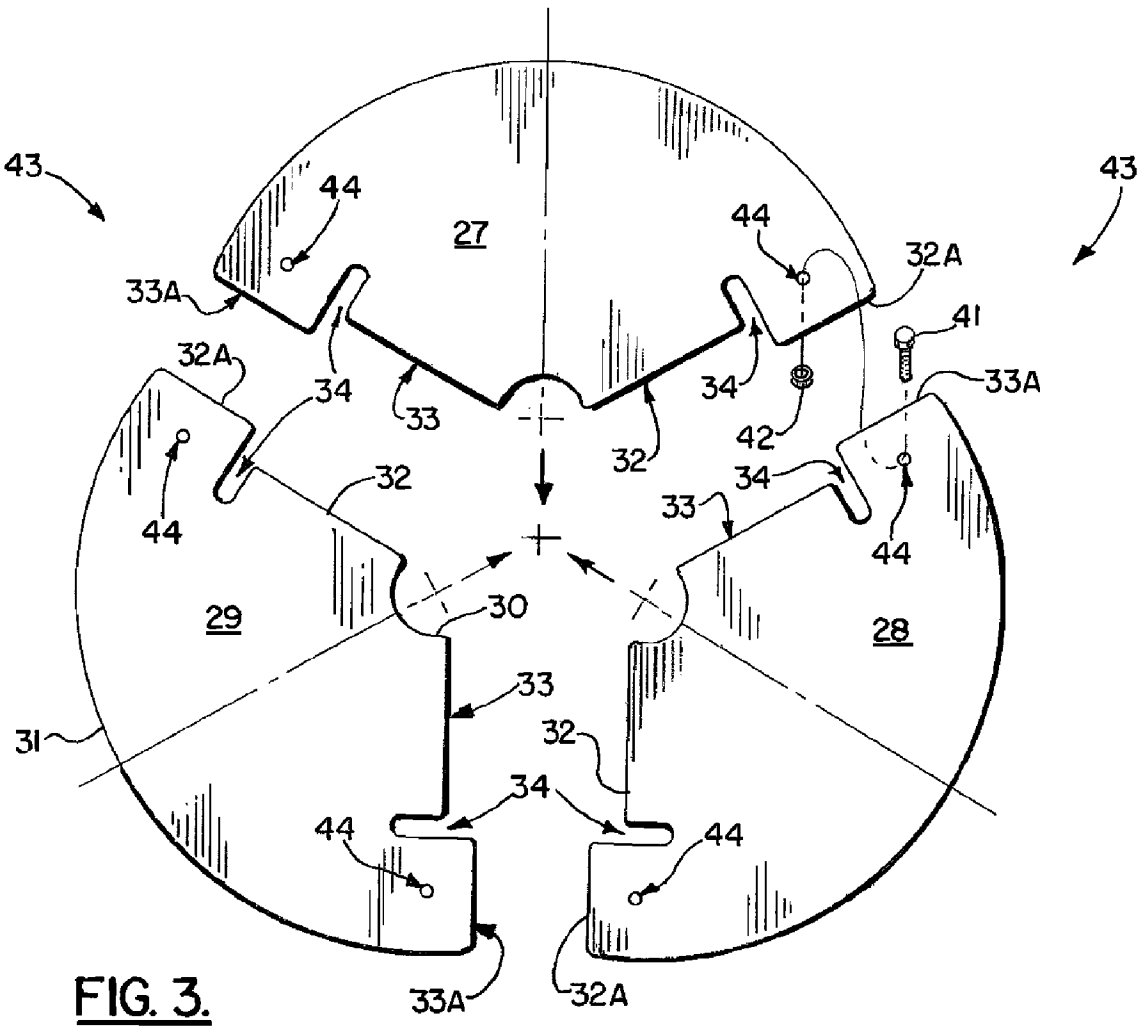
FIG. 3 is a partial plan exploded view of the preferred embodiment of the apparatus of the present invention.

FIG. 3 shows the baffle sections 27, 28, 29 removed from burner frame 38 to illustrate more clearly the construction of each. The baffle sections 27, 28, 29 can be placed inside of a box with the burner frame 38 for shipment or storage, occupying a space smaller than the area 40 within feet 21 of frame 38.

Figure 5:
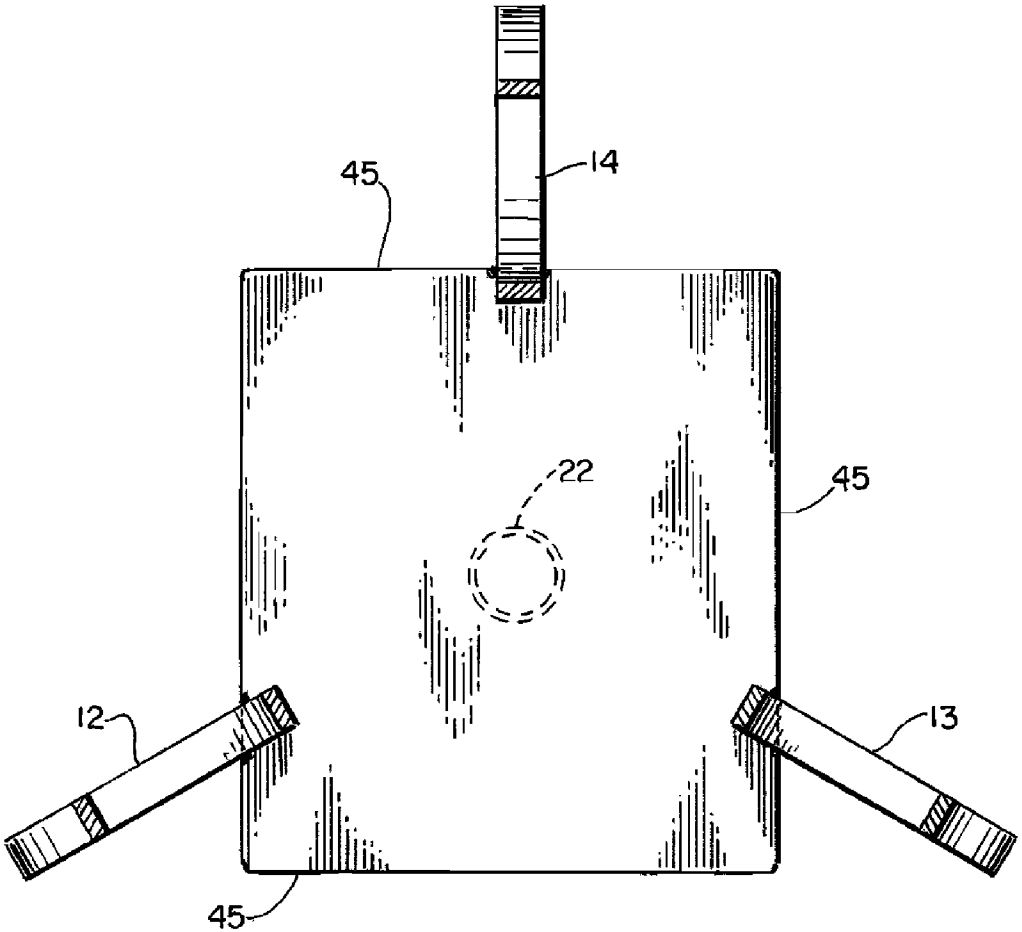
FIG. 5 is a sectional view taken along lines 5-5 of FIG. 2.

A second baffle or heat shield 45 can be provided as seen in FIGS. 2 and 5. Baffle or heat shield 45 can be connected (e.g. welded) to legs 12, 13, 14 at a position below nozzle tube 22 (see FIG. 2). Baffle or heat shield 45 further prevents or reduces substantial heat transfer from the flame in tube 22 downwardly to surface 11.

The following is a list of parts and materials suitable for use in the present invention:

PARTS LIST

| Parts Number | Description |
|---|---|
| 10 | outdoor cooking apparatus |
| 11 | underlying support surface |
| 12 | leg |
| 13 | leg |
| 14 | leg |
| 15 | grate |
| 16 | ring |
| 17 | pot support bar |
| 18 | joint (e.g. weld) |
| 19 | outer leg section |
| 20 | inner leg section |
| 21 | bend or foot |
| 22 | nozzle tube |
| 23 | jet baffle |
| 24 | weld (leg to tube) |
| 25 | nozzle tube bore |
| 26 | fuel line/burner element |
| 27 | baffle section |
| 28 | baffle section |
| 29 | baffle section |
| 30 | arcuate inner edge |
| 31 | arcuate outer edge |
| 32 | radial edge |
| 32A | radial edge |
| 33 | radial edge |
| 33A | radial edge |
| 34 | slot |
| 35 | bolted connection |
| 36 | area of overlap |
| 37 | leg opening |
| 38 | burner frame |
| 39 | upper end portion |
| 40 | area |
| 41 | bolt |
| 42 | nut |
| 43 | baffle/heat shield |
| 44 | opening |
| 45 | baffle/heat shield |

The foregoing embodiments are presented by way of example only; the scope of the present invention is to be limited only by the following claims.

The invention claimed is:

1. A cooking apparatus, comprising:

a) a burner having a frame that includes a base for engaging an underlying support surface, the base including one or more legs, the frame having a burner element for generating a high intensity flame for use in cooking, the burner frame having an upper end portion with a support surface for cradling a pot;

b) the frame including a nozzle tube having upper and lower end portions, the nozzle tube being positioned to extend above the burner element and providing an open ended bore that contains the flame generated by the burner element during cooking;

c) the frame including pot supports next to the upper end portion for holding a pot;

d) at least one heat shield that is positioned below the flame during cooking and that is connected to the nozzle tube and that extends radially and circumferentially with respect to the nozzle tube;

e) the lower end portion of the nozzle tube providing an open end portion that extends below the heat shield;

f) the heat shield including a plurality of sections that each overlap wherein a portion of one section is stacked vertically above a portion of another section, each section having edges with one or more slots communicating with an edge, each slot being receptive of a leg; and g) wherein each leg is surrounded by edges of two of said heat shield sections, wherein vertically stacked portions of two of said sections abut a said leg.

2. The cooking apparatus of claim 1, wherein the base includes a ring.

3. The cooking apparatus of claim 2 wherein the legs are attached to the ring.

4. The cooking apparatus of claim 1 wherein the upper end portion includes a circular ring portion of the frame.

5. The cooking apparatus of claim 1 wherein there are at least three heat shield sections.

6. The cooking apparatus of claim 1 further comprising a cooking pot.

7. The cooking apparatus of claim 1 wherein slots on each of two adjacent heat shield sections form leg openings.

8. A cooking apparatus, comprising:

a) a burner having a frame that includes a base for engaging an underlying support surface, the base including one or more legs, the frame having a burner element for generating a high intensity flame for use in cooking, the burner frame having an upper end portion with a support surface for cradling a pot;

b) the frame including a nozzle tube having upper and lower end portions, the nozzle tube being positioned to extend above the burner element and providing an open ended bore that contains the flame generated by the burner element during cooking;

c) the frame including pot supports next to the upper end portion for holding a pot;

d) at least one heat shield that is positioned below the flame during cooking and that is connected to the nozzle tube and that extends radially and circumferentially with respect to the nozzle tube;

e) the lower end portion of the nozzle tube providing an open end portion that extends below the heat shield;

f) the heat shield including a plurality of sections that overlap wherein a portion of one section is stacked vertically above a portion of another section, each section having edges with one or more slots that are receptive of a leg;

g) wherein each leg is surrounded by edges of two of said heat shield sections, wherein vertically stacked portions of two of said sections abut a said leg; and h) wherein the said overlapping, vertically stacked portions of the heat shield sections are bolted together.

9. A cooking apparatus, comprising:

a) a burner having a frame that includes a base with legs for engaging an underlying support surface;

b) the frame supporting a burner element for generating a high intensity flame for use in cooking;

c) a pot support surface on the frame for holding a pot above the frame;

d) the frame including a nozzle tube that houses a nozzle for emitting gaseous fuel that is ignited during use to form a flame that extends from the nozzle tube upwardly to a pot supported upon the upper end of the frame, the nozzle tube being an open ended tubular member having upper and lower end portions;

e) multiple pie shaped baffle sections connected together and secured to the frame, each baffle section having edges;

f) leg openings that surround each leg, the baffle sections reflecting heat generated by the flame away from the underlying support surface, each baffle section extending radially and circumferentially with respect to the nozzle tube;

g) wherein a portion of one baffle section is stacked vertically above a portion of another baffle section;

h) wherein each leg is surrounded by edges of two of said baffle sections, wherein vertically stacked portions of two of said sections abut a said leg; and i) a fastener that holds the pair of vertically stacked portions together.

10. The cooking apparatus of claim 9 wherein there are at least three circumferentially spaced apart pot supports that comprise the pot support surface.

11. The cooking apparatus of claim 9 wherein the upper end portion of the frame includes an upper ring portion.

12. The cooking apparatus of claim 11 wherein the upper ring further comprises multiple pot supports.

13. A cooking apparatus, comprising:

a) a burner having a frame that includes a base with legs for engaging an underlying support surface;

b) the frame supporting a burner element for generating a high intensity flame for use in cooking;

c) a pot support surface on the frame for holding a pot above the frame;

d) the frame including a nozzle tube that houses a nozzle for emitting gaseous fuel that is ignited during use to form a flame that extends from the nozzle tube upwardly to a pot supported upon the upper end of the frame, the nozzle tube being an open ended tubular member having upper and lower end portions;

e) multiple pie shaped baffle sections connected together and secured to the frame;

f) the baffle sections having leg openings that surround the legs, the baffle sections reflecting heat generated by the flame away from the underlying support surface, each section extending radially and circumferentially with respect to the nozzle tube;

g) wherein a portion of one baffle section is stacked vertically above a portion of another baffle section;

h) wherein each leg is surrounded by edges of two of said baffle sections, wherein vertically stacked portions of two of said sections abut a said leg; and i) wherein bolted connections hold the baffle sections together.

14. A cooking apparatus, comprising:

a) a burner having a frame that includes a base with legs for engaging an underlying support surface;

b) the frame supporting a burner element for generating a high intensity flame for use in cooking;

c) a pot support surface on the frame for holding a pot above the frame;

d) the frame including a nozzle tube that houses a nozzle for emitting gaseous fuel that is ignited during use to form a flame that extends from the nozzle tube upwardly to a pot supported upon the upper end of the frame, the nozzle tube being an open ended tubular member having upper and lower end portions;

e) multiple pie shaped baffle sections connected together and secured to the frame, each baffle section having a leg opening that surrounds a leg, the baffle sections reflecting heat generated by the flame away from the underlying support surface, each section extending radially and circumferentially with respect to the nozzle tube;

f) wherein a portion of one baffle section is stacked vertically above a portion of another baffle section;

g) wherein each leg is surrounded by edges of two of said baffle sections, wherein vertically stacked portions of two of said baffle sections abut a said leg;

h) fasteners that extend through the vertically stacked portions to fasten the baffle sections together; and i) wherein the base is defined by multiple legs and feet on the legs.

* * * * *